US009840674B2

(12) United States Patent
Weiss et al.

(10) Patent No.: US 9,840,674 B2
(45) **Date of Patent: *Dec. 12, 2017**

(54) PROCESS FOR CONVERTING PETROLEUM FEEDSTOCKS COMPRISING AN EBULLATING-BED HYDROCRACKING STAGE, A MATURATION STAGE AND A STAGE OF SEPARATING THE SEDIMENTS FOR THE PRODUCTION OF FUEL OILS WITH A LOW SEDIMENT CONTENT

(71) Applicant: IFP Energies nouvelles, Rueil-Malmaison (FR)

(72) Inventors: Wilfried Weiss, Valencin (FR); Jeremie Barbier, Rive de Gier (FR)

(73) Assignee: IFP Energies nouveles, Rueil-Malmaison (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/931,395

(22) Filed: Nov. 3, 2015

(65) Prior Publication Data

US 2016/0160136 A1 Jun. 9, 2016

(30) Foreign Application Priority Data

Nov. 4, 2014 (FR) ..... 14 60628

(51) Int. Cl.
*C10G 67/02* (2006.01)
*C10G 31/06* (2006.01)
(Continued)

(52) U.S. Cl.
CPC ..... *C10G 67/02* (2013.01); *C10G 31/06* (2013.01); *C10G 49/002* (2013.01); *C10G 65/12* (2013.01);
(Continued)

(58) Field of Classification Search
CPC ..... C10G 67/02; C10G 31/06; C10G 49/002; C10G 65/12; C10G 2300/107;
(Continued)

(56) References Cited

U.S. PATENT DOCUMENTS 2,988,501 A 6/1961 Inwood et al.
4,732,664 A * 3/1988 Solari Martini ..... C10G 21/003 208/112
(Continued)

FOREIGN PATENT DOCUMENTS

FR 2981659 A1 4/2013

OTHER PUBLICATIONS

Search Report for French Application No. 14/60.628 dated Jul. 13, 2015.

*Primary Examiner* — Prem C Singh
*Assistant Examiner* — Brandi M Doyle
(74) *Attorney, Agent, or Firm* — Millen White Zelano & Branigan, P.C.

(57) ABSTRACT

The invention relates to a process for converting a hydrocarbon-containing feedstock containing at least one hydrocarbon fraction having a sulphur content of at least 0.1% by weight, an initial boiling temperature of at least 340° C. and a final boiling temperature of at least 440° C., making it possible to obtain a heavy fraction having a sediment content after ageing of less than or equal to 0.1% by weight, said process comprising the following stages: a) a stage of hydrocracking the feedstock in the presence of hydrogen in at least one reactor containing a supported catalyst in an ebullating bed, b) a stage of separating the effluent obtained at the end of stage a), c) a stage of maturation of the heavy fraction originating from the separation stage b), d) a stage
(Continued)

of separating the sediments from the heavy fraction originating from the maturation stage c) to obtain said heavy fraction.

17 Claims, 1 Drawing Sheet

(51) Int. Cl.
*C10G 49/00* (2006.01)
*C10G 65/12* (2006.01)

(52) U.S. Cl.
CPC ..... *C10G 2300/107* (2013.01); *C10G 2300/1077* (2013.01); *C10G 2300/202* (2013.01); *C10G 2300/206* (2013.01); *C10G 2300/208* (2013.01)

(58) Field of Classification Search
CPC ..... C10G 2300/1077; C10G 2300/202; C10G 2300/206; C10G 2300/208
See application file for complete search history.

(56) References Cited

U.S. PATENT DOCUMENTS

| | | | | |
|---|---|---|---|---|
| 6,447,671 | B1 * | 9/2002 | Morel | C10G 65/04 208/210 |
| 2005/0241991 | A1 * | 11/2005 | Lott | B01J 8/226 208/108 |
| 2013/0026074 | A1 | 1/2013 | Koseoglu et al. | |
| 2014/0027344 | A1 * | 1/2014 | Harris | C10G 47/12 208/61 |
| 2014/0299515 | A1 | 10/2014 | Weiss et al. | |

* cited by examiner

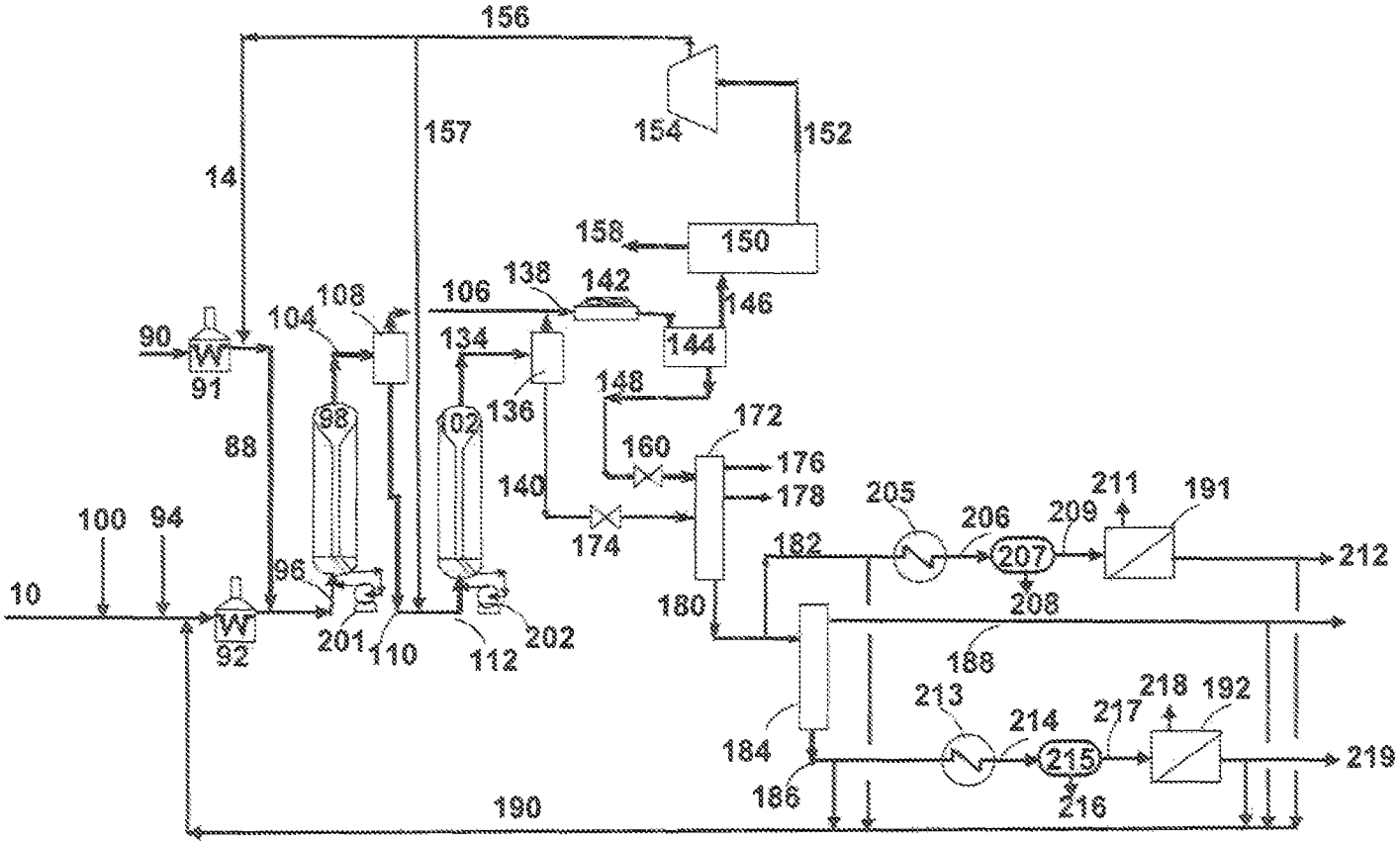
10
14
88
90
91
92
94
100
102
104
106
108
110
112
134
136
138
140
142
144
146
148
150
152
154
156
157
160
172
174
176
178
180
182
184
186
188
190
191
192
201
202
205
206
207
208
209
211
212
213
214
215
216
217
218
219

PROCESS FOR CONVERTING PETROLEUM FEEDSTOCKS COMPRISING AN EBULLATING-BED HYDROCRACKING STAGE, A MATURATION STAGE AND A STAGE OF SEPARATING THE SEDIMENTS FOR THE PRODUCTION OF FUEL OILS WITH A LOW SEDIMENT CONTENT

The present invention relates to the refining and conversion of heavy hydrocarbon fractions containing, among other things, sulphur-containing impurities. It relates more particularly to a process for converting heavy petroleum feedstocks of the atmospheric residue and/or vacuum residue type for the production of heavy fractions that can be used as fuel-oil bases, in particular bunker oil bases, with a low sediment content. The process according to the invention also makes it possible to produce atmospheric distillates (naphtha, kerosene and diesel), vacuum distillates and light gases (C1 to C4).

The quality requirements for marine fuels are described in standard ISO 8217. From now on the specification concerning sulphur will relate to $SO_x$ emissions (Annex VI of the MARPOL convention of the International Maritime Organization) and is expressed as a recommendation for the sulphur content to be less than or equal to 0.5% by weight outside the Sulphur Emissions Control Areas (SECAs) for the 2020-2025 time frame, and less than or equal to 0.1% by weight in the SECAs. According to Annex VI of the MARPOL convention, the sulphur contents mentioned previously are equivalent contents resulting in SOx emissions. A vessel will therefore be able to use a sulphur-containing fuel oil if the vessel is equipped with a system for treating fumes that makes it possible to reduce emissions of sulphur oxides.

Another very restrictive recommendation is the sediment content after ageing according to ISO 10307-2 (also known as IP390), which must be less than or equal to 0.1%.

The sediment content according to ISO 10307-1 (also known as IP375) is different from the sediment content after ageing according to ISO 10307-2 (also known as IP390). The sediment content after ageing according to ISO 10307-2 is a much more restrictive specification and corresponds to the specification that applies to bunker oils.

On the other hand, land-based fuel oils, in particular fuel oils which can be used for the production of heat and/or electricity can also be subjected to stability specifications, in particular maximum sediment contents the thresholds of which vary as a function of the places of production as there is no international harmonization as in the case of maritime transport. There is, however, interest in reducing the sediment content of land-based fuel oils.

The processes for hydrocracking residues make it possible to convert low-value residues to distillates with a higher added value. The resulting heavy fraction corresponding to the unconverted residual cut is generally unstable. It contains sediments which are mainly precipitated asphaltenes. This unstable residual cut therefore cannot be upscaled as a fuel oil, in particular as a bunker oil, without a specific treatment when the hydrocracking is carried out under severe conditions leading to a high conversion rate.

The U.S. Pat. No. 6,447,671 describes a process for converting heavy petroleum fractions comprising a first ebullating-bed hydrocracking stage, a stage of eliminating catalyst particles contained in the hydrocracking effluent, then a fixed-bed hydrotreatment stage.

The application US2014/0034549 describes a process for converting residues implementing an ebullating-bed hydrocracking stage and a stage with a so-called "upflow" reactor combined with a so-called "stripper" reactor. The sediment content of the final effluent is reduced compared with the effluent from the ebullating-bed stage. However, the sediment content after ageing is not less than 0.1% by weight, as is required for sale as a marine fuel of the residue type.

The patent FR2981659 describes a process for converting heavy petroleum fractions comprising a first ebullating-bed hydrocracking stage and a stage of fixed-bed hydrotreatment comprising switchable reactors.

The hydrocracking process makes it possible to partially convert the heavy feedstocks in order to produce atmospheric distillates and/or vacuum distillates.

Although the ebullating-bed technology is known to be suitable for heavy feedstocks loaded with impurities, by its nature the ebullating bed produces catalyst fines and sediments which must be removed in order to satisfy a product quality such as bunker oil. The fines result principally from attrition of the catalyst in the ebullating bed.

The sediments can be precipitated asphaltenes. Initially, the hydrocracking conditions and in particular the temperature in the feedstock cause them to undergo reactions (dealkylation, polymerization, etc.) leading to their precipitation. Independently of the nature of the feedstock, these phenomena generally occur when severe conditions bringing about high conversion rates (for compounds boiling at more than 540° C.: 540+° C.), i.e. greater than 30, 40 or 50% depending on the nature of the feedstock, are used.

In his research, the applicant has developed a new process incorporating a stage of maturation and separation of the sediments downstream of a hydrocracking stage. It was surprisingly found that such a process made it possible to obtain heavy fractions having a low sediment content after ageing, said heavy fractions advantageously being able to be used completely or partially as a fuel oil or as a fuel-oil base, in particular as a bunker oil or bunker oil base, complying with the specifications, namely having a sediment content after ageing of less than or equal to 0.1% by weight.

An advantage of the process according to the invention is in particular the prevention of the risks of clogging the boat engines and, in the case of any treatment stages implemented downstream of the hydrocracking stage, preventing a clogging of the catalytic bed(s) used.

More particularly, the invention relates to a process for converting a hydrocarbon-containing feedstock containing at least one hydrocarbon fraction having a sulphur content of at least 0.1% by weight, an initial boiling temperature of at least 340° C. and a final boiling temperature of at least 440° C., making it possible to obtain a heavy fraction having a sediment content after ageing of less than or equal to 0.1% by weight, said process comprising the following stages:

a) a stage of hydrocracking the feedstock in the presence of hydrogen in at least one reactor containing a supported catalyst in an ebullating bed, b) a stage of separating the effluent obtained at the end of stage a) into at least one light hydrocarbon fraction containing fuel bases and a heavy fraction containing compounds boiling at at least 350° C., c) a stage of maturation of the heavy fraction originating from the separation stage b) making it possible to convert a part of the potential sediments to existing sediments, carried out for a duration comprised between 1 and 1500 minutes, at a temperature comprised between 50 and 350° C., and at a pressure of less than 20 MPa, d) a stage of separating the sediments from the heavy fraction originating from the maturation stage c) in order to obtain said heavy fraction.

In order to constitute the fuel oil complying with the viscosity recommendations, the heavy fractions obtained using the present process can be mixed with fluxing bases so as to achieve the target viscosity of the desired fuel oil grade.

Another beneficial point of the process is the partial conversion of the feedstock making it possible to produce, in particular by hydrocracking, atmospheric distillates or vacuum distillates (naphtha, kerosene, diesel, vacuum distillate), that can be upscaled as bases in the fuel pools directly or after passing through another refining process such as hydrotreatment, reforming, isomerization, hydrocracking or catalytic cracking.

BRIEF DESCRIPTION OF FIG. 1

FIG. 1 illustrates a diagrammatic view of the process according to the invention showing a hydrocracking zone, a separation zone, a zone for the maturation and separation of the sediments.

DETAILED DESCRIPTION

The Feedstock

The feedstocks treated in the process according to the invention are advantageously selected from atmospheric residues, vacuum residues originating from direct distillation, crude oils, topped crude oils, deasphalted oils, deasphalting resins, asphalts or deasphalting pitches, residues originating from conversion processes, aromatic extracts originating from lubricant base production chains, bituminous sands or derivatives thereof, oil shales or derivatives thereof, alone or in a mixture.

These feedstocks can advantageously be used as they are or also diluted with a hydrocarbon-containing fraction or a mixture of hydrocarbon-containing fractions which can be selected from the products originating from a fluid catalytic cracking (FCC) process, a light cut oil (or light cycle oil, LCO), a heavy cut oil (or heavy cycle oil, HCO), a decanted oil (DO), an FCC residue, or which can originate from distillation, gas oil fractions, in particular those obtained by atmospheric or vacuum distillation, such as for example vacuum gas oil. The heavy feedstocks can also advantageously comprise cuts originating from the process for liquefaction of coal or biomass, aromatic extracts, or any other hydrocarbon-containing cuts or also non-petroleum feedstocks such as pyrolysis oil.

The feedstocks according to the invention generally have a sulphur content of at least 0.1% by weight, an initial boiling temperature of at least 340° C. and a final boiling temperature of at least 440° C., preferably a final boiling temperature of at least 540° C. Advantageously, the feedstock can contain at least 1% C7 asphaltenes and at least 5 ppm of metals, preferably at least 2% C7 asphaltenes and at least 25 ppm of metals.

The feedstocks according to the invention are preferably atmospheric residues or vacuum residues, or mixtures of these residues.

Stage a): Hydrocracking

The feedstock according to the invention is subjected to a hydrocracking stage which is carried out in at least one reactor containing a supported catalyst in an ebullating bed and preferably operating with ascending flow of liquid and of gas. The objective of the hydrocracking stage is to convert the heavy fraction into lighter cuts while partially refining the feedstock.

As the ebullating-bed technology is largely known, only the main operating conditions will be covered here.

Ebullating-bed technologies use supported ebullating-bed catalysts in the form of extrudates, the diameter of which is generally of the order of 1 mm or less than 1 mm. The catalysts remain within the reactors and are not evacuated with the products. The temperature levels are high in order to obtain high conversions while minimizing the quantities of catalysts used. The catalytic activity can be kept constant due to in-line replacement of the catalyst. It is therefore not necessary to stop the unit in order to replace the spent catalyst, nor to increase the reaction temperatures throughout the cycle in order to compensate for deactivation. In addition, working under constant operating conditions makes it possible to obtain constant yields and product qualities throughout the cycle. Thus, because the catalyst is kept under agitation by significant liquid recycling, the pressure drop in the reactor remains low and constant.

The conditions of the stage a) of hydrocracking the feedstock in the presence of hydrogen are normally conventional conditions of hydrocracking a liquid hydrocarbon-containing fraction in an ebullating bed. Advantageously, implementation is under a partial pressure of hydrogen of 5 to 35 MPa, often of 8 to 25 MPa and most often of 12 to 20 MPa at a temperature of 330 to 500° C. and often of 350 to 450° C. The hourly space velocity (HSV) and the partial pressure of hydrogen are significant factors which are selected as a function of the characteristics of the product to be treated and of the desired conversion. The HSV, defined as being the volumetric flow of the feedstock divided by the total volume of the reactor, is generally situated in a range from 0.05 $h^{-1}$ to 5 $h^{-1}$, preferably 0.1 $h^{-1}$ to 2 $h^{-1}$ and more preferably 0.2 $h^{-1}$ to 1 $h^{-1}$. The quantity of hydrogen mixed with the feedstock is usually 50 to 5000 $Nm^3/m^3$ (normal cubic meters ($Nm^3$) per cubic meter ($m^3$) of liquid feedstock) and most often 100 to 1000 $Nm^3/m^3$ and preferably 200 to 500 $Nm^3/m^3$.

A conventional granular hydrocracking catalyst can be used, comprising, on an amorphous support, at least one metal or metal compound having a hydrodehydrogenating function. This catalyst can be a catalyst comprising metals of group VIII, for example nickel and/or cobalt, most often combined with at least one metal of group VIB, for example molybdenum and/or tungsten. For example a catalyst comprising 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on an amorphous mineral support can be used. This support will, for example, be selected from the group formed by alumina, silica, silica-aluminas, magnesia, clays and mixtures of at least two of these minerals. This support can also include other compounds and, for example, oxides selected from the group formed by boron oxide, zirconia, titanium oxide, phosphoric anhydride. An alumina support is most often used, and a support of alumina doped with phosphorus and optionally boron is very often used. When phosphoric anhydride $P_2O_5$ is present, the concentration thereof is normally less than 20% by weight and most often less than 10% by weight. The concentration of boron trioxide $B_2O_3$ is normally 0 to 10% by weight. The alumina used is normally a gamma or eta alumina. This catalyst is most often in the form of extrudates. The total content of oxides of metals of groups VI and VIII is often 5 to 40% by weight and generally 7 to 30% by weight and the weight ratio expressed as metallic oxide between a metal (or metals) of group VI and a metal (or metals) of group VIII is generally 20 to 1 and most often 10 to 2.

The spent catalyst is partially replaced by fresh catalyst, generally by drawing-off from the base of the reactor and introduction of fresh or new catalyst at the top of the reactor at regular time intervals, i.e., for example, in batches or in an almost continuous manner. The catalyst can also be introduced through the base and drawn off from the top of the reactor. For example, fresh catalyst can be introduced every day. The rate of replacement of the used catalyst by fresh catalyst can be, for example, from approximately 0.05 kilograms to approximately 10 kilograms per cubic meter of feedstock. This drawing-off and replacement are carried out using devices allowing continuous operation of this hydrocracking stage. The unit normally comprises a recirculation pump making it possible to maintain the catalyst in the ebullating bed by continuous recycling of at least a part of the liquid drawn off at the top of the reactor and reinjected into the bottom of the reactor. It is also possible to send the used catalyst drawn off from the reactor into a regeneration zone in which the carbon and the sulphur that it contains are removed before it is reinjected into the hydrocracking stage a).

Most often, the hydrocracking stage a) is implemented under the conditions of the H-OIL® process as is described for example in U.S. Pat. No. 6,270,654.

Hydrocracking can be carried out in a single reactor or in several reactors (generally two) arranged in series. The use of at least two ebullating-bed reactors in series makes it possible to obtain products of better quality and with a better yield, thus limiting the energy and hydrogen requirements in any post-treatments. In addition, hydrocracking in two reactors makes it possible to have an improved operability in relation to the flexibility of the operating conditions and of the catalytic system. In general, the temperature of the second reactor is preferably at least 5° C. higher than that of the first ebullating-bed reactor. The pressure of the second reactor is from 0.1 to 1 MPa lower than for the first reactor in order to make it possible for at least a part of the effluent originating from the first stage to flow without pumping being necessary. The different operating conditions in terms of temperature in the two hydrocracking reactors are selected in order to be able to control the hydrogenation and the conversion of the feedstock into the products desired in each reactor. Optionally, the effluent obtained at the outlet from the first hydrocracking reactor is subjected to a separation of the light fraction and at least a part, preferably all, of the residual effluent is treated in the second hydrocracking reactor.

This separation can be carried out in an inter-stage separator such as is described in the U.S. Pat. No. 6,270,654 and in particular makes it possible to avoid too severe hydrocracking of the light fraction in the second hydrocracking reactor.

It is also possible to transfer all or part of the spent catalyst drawn off from the first hydrocracking reactor, operating at a lower temperature, directly into the second hydrocracking reactor, operating at a higher temperature, or to transfer all or part of the spent catalyst drawn off from the second hydrocracking reactor directly to the first hydrocracking reactor. This cascade system is described in the U.S. Pat. No. 4,816,841.

The hydrocracking stage can also be carried out in at least one reactor operating in hybrid bed mode, i.e. operating using an ebullating bed with a supported catalyst combined with a dispersed catalyst constituted by very fine particles of catalyst, all forming a suspension with the feedstock to be treated.

A hybrid bed comprises two populations of catalyst, a population of catalyst of the ebullating bed type to which a population of catalyst of the "dispersed" type is added. The term "dispersed" denotes an implementation of the reactor in which the catalyst is in the form of very fine particles, i.e. generally with a size comprised between 1 nanometer (or $10^{-9}$ m) and 150 micrometers, preferably between 0.1 and 100 micrometers, and even more preferably between 10 and 80 microns.

In a first variant, the hydrocracking stage can comprise a first reactor of the ebullating bed type followed by a second reactor of the hybrid bed type (i.e. of the ebullating bed type injected with "dispersed"-type catalyst).

In a second variant, the hydrocracking stage can comprise a first reactor of the hybrid bed type followed by a second reactor of the hybrid type.

In a third variant, the hydrocracking stage can comprise a single reactor of the hybrid bed type.

The "dispersed" catalyst used in the hybrid bed reactor can be a sulphide catalyst preferably containing at least one element selected from the group formed by Mo, Fe, Ni, W, Co, V, Ru. These catalysts are generally mono-metallic or bi-metallic (combining, for example, a non-noble element of group VIIIB (Co, Ni, Fe) and an element of group VIB (Mo, W). The catalysts used can be powders of heterogeneous solids (such as natural minerals, iron sulphate, etc), dispersed catalysts originating from precursors soluble in water such as phosphomolybdic acid, ammonium molybdate, or a mixture of Mo or Ni oxide with aqueous ammonia. Preferably, the catalysts used originate from precursors soluble in an organic phase (catalysts soluble in oil).

The precursors are generally organo-metallic compounds such as the naphthenates of Mo, Co, Fe, or Ni, or the octoates of Mo, or multi-carbonyl compounds of these metals, for example 2-ethyl hexanoates of Mo or Ni, acetylacetonates of Mo or Ni, salts of C7-C12 fatty acids of Mo or W, etc. They can be used in the presence of a surfactant agent in order to improve the dispersion of the metals, when the catalyst is bi-metallic. The catalysts are in the form of particles that are dispersed or colloidal, or not colloidal, according to the nature of the catalyst. Such precursors and catalysts which can be used in the process according to the invention are widely described in the literature.

In general, the catalysts are prepared before being injected into the feedstock. The preparation process is adapted as a function of the state in which the precursor is and its nature. In all cases, the precursor is sulphurized (ex situ or in situ) in order to form the dispersed catalyst in the feedstock.

In the case of catalysts known as soluble in oil, the precursor is advantageously mixed with a carbon-containing feedstock (which can be part of the feedstock to be treated, an external feedstock, a recycled fraction, etc.), the mixture is then sulphurized by addition of a sulphur-containing compound (preferably hydrogen sulphide or possibly an organic sulphide such as DMDS in the presence of hydrogen) and heated. The preparation of these catalysts is described in the literature. The particles of "dispersed" catalysts as defined above (powders of metallic mineral compounds or originating from precursors soluble in water or in oil) generally have a size comprised between 1 nanometer and 150 micrometers, preferably between 0.1 and 100 micrometers, and even more preferably between 10 and 80 microns. The content of catalytic compounds (expressed as a percentage by weight of metallic elements of group VIII and/or of group VIB) is comprised between 0 and 10% by weight, preferably between 0 and 1% by weight.

Additives can be added during the preparation of the catalyst or to the "dispersed" catalyst before it is injected into the reactor. These additives are described in the literature.

The preferred solid additives are mineral oxides such as alumina, silica, mixed oxides of Al/Si, spent supported catalysts (for example, on alumina and/or silica) containing at least one element of group VIII (such as Ni, Co) and/or at least one element of group VIB (such as Mo, W). For example, the catalysts described in the application US2008/177124 will be mentioned. Carbon-containing solids with a low hydrogen content (for example 4% hydrogen) such as coke or ground activated charcoal, optionally pre-treated, can also be used. Mixtures of such additives can also be used. The particle size of the additive is generally comprised between 10 and 750 microns, preferably between 100 and 600 microns. The content of any solid additive present at the inlet to the reaction zone of the "dispersed" hydrocracking process is comprised between 0 and 10% by weight, preferably between 1 and 3% by weight, and the content of catalytic compounds (expressed as a percentage by weight of metallic elements of group VIII and/or of group VIB) is comprised between 0 and 10% by weight, preferably between 0 and 1% by weight.

The hybrid bed reactor(s) used in the hydrocracking zone are therefore constituted by two populations of catalysts, a first population using supported catalysts in the form of extrudates the diameter of which is advantageously comprised between 0.8 and 1.2 mm, generally equal to 0.9 mm or 1.1 mm and a second population of "dispersed"-type catalyst, mentioned above.

The fluidization of the catalyst particles in the ebullating bed is made possible by the use of an ebullation pump which allows a recycling of liquid, generally inside the reactor. The flow of liquid recycled by the ebullation pump is adjusted so that the particles of supported catalysts are fluidized but not transported, so that these particles remain in the ebullating-bed reactor (with the exception of the catalyst fines which can be formed by attrition and entrained with the liquid since these fines are small in size). In the case of a hybrid bed, the "dispersed"-type catalyst is also carried with the liquid because the "dispersed"-type catalyst is constituted by particles of very small size.

Stage b): Separation of the Hydrocracking Effluent

The effluent obtained at the end of the hydrocracking stage a) undergoes at least one separation stage, optionally supplemented by other additional separation stages, making it possible to separate at least one light hydrocarbon fraction containing fuel bases and a heavy fraction containing compounds boiling at at least 350° C.

The separation stage can advantageously be implemented using any method known to a person skilled in the art, such as for example the combination of one or more high- and/or low-pressure separators, and/or high- and/or low-pressure distillation and/or stripping stages. Preferably, the separation stage b) makes it possible to obtain a gaseous phase, at least one light hydrocarbon fraction of the naphtha, kerosene and/or diesel type, a vacuum distillate fraction and a vacuum residue fraction and/or an atmospheric residue fraction.

The separation can be carried out in a fractionation section which can firstly comprise a high pressure high temperature (HPHT) separator, and optionally a high pressure low temperature (HPLT) separator, and/or an atmospheric distillation and/or a vacuum distillation. The effluent obtained at the end of stage a) is separated (generally in an HPHT separator) into a light fraction and a heavy fraction containing mainly compounds boiling at at least 350° C. The cut point of the separation is advantageously situated between 200 and 400° C.

In a variant of the process of the invention, the effluent originating from the hydrocracking can, during stage b), also undergo a succession of flash comprising at least one high pressure high temperature (HPHT) flask and a low pressure high temperature (LPHT) flask to separate a heavy fraction which is sent into a vapour stripping stage making it possible to eliminate from said heavy fraction at least one light fraction rich in hydrogen sulphide. The heavy fraction recovered at the bottom of the stripping column contains compounds boiling at at least 350° C. but also atmospheric distillates. According to the process of the invention, said heavy fraction separated from the light fraction rich in hydrogen sulphide is then sent into the maturation stage c) then into the sediment separation stage d).

In a variant, at least a part of the so-called heavy fraction originating from stage b) is fractionated by atmospheric distillation into at least one atmospheric distillate fraction containing at least one light hydrocarbon fraction of the naphtha, kerosene and/or diesel type and an atmospheric residue fraction. At least a part of the atmospheric residue fraction can be sent into the maturation stage c) then into the sediment separation stage d).

The atmospheric residue can also be at least partially fractionated by vacuum distillation into a vacuum distillate fraction containing vacuum gas oil and a vacuum residue fraction. Said vacuum residue fraction is advantageously at least partially sent into the maturation stage c) then into the sediment separation stage d).

At least a part of the vacuum distillate and/or of the vacuum residue can also be recycled into the hydrocracking stage a).

Whatever the separation method used, the light fraction(s) obtained can undergo other separation stages, optionally in the presence of the light fraction originating from the inter-stage separator between the two hydrocracking reactors.

Advantageously, it (or they) is (or are) subjected to an atmospheric distillation making it possible to obtain a gaseous fraction, at least one light hydrocarbon fraction of the naphtha, kerosene and/or diesel type and a vacuum distillate fraction.

A part of the atmospheric distillate and/or of the vacuum distillate originating from the separation stage b) can constitute a part of a fuel oil such as a fluxing agent. These cuts can also constitute low-viscosity marine fuels (Marine Diesel Oil (MDO) or Marine Gas Oil (MOO)). Another part of the vacuum distillate can also be upscaled by hydrocracking and/or by fluid catalytic cracking.

The gaseous fractions originating from the separation stage preferably undergo a purification treatment to recover the hydrogen and to recycle it to the hydrocracking reactors (stage a)).

The upscaling of the different cuts of fuel bases (LPG, naphtha, kerosene, diesel and/or vacuum gas oil) obtained using the present invention is well known to a person skilled in the art. The products obtained can be incorporated in fuel reservoirs (also called fuel "pools") or can undergo additional refining stages. The naphtha, kerosene, gas oil fraction(s) and the vacuum gas oil can be subjected to one or more treatments (hydrotreatment, hydrocracking, alkylation, isomerization, catalytic reforming, catalytic or thermal cracking or others) to bring them to the required specifications (sulphur content, smoke, octane and cetane point, etc.) separately or in a mixture.

Advantageously, the vacuum distillate leaving the ebullating bed after separation can undergo a hydrotreatment. This hydrotreated vacuum distillate can be used as fluxing agent for the fuel oil pool having a sulphur content of less than or equal to 0.5% by weight or be upscaled directly as fuel oil having a sulphur content of less than or equal to 0.1% by weight.

A part of the atmospheric residue, of the vacuum distillate and/or of the vacuum residue can undergo other additional refining stages such as a hydrotreatment, a hydrocracking, or a fluid catalytic cracking.

Stage c): Maturation of the Sediments

The heavy fraction obtained at the end of the separation stage b) contains organic sediments which result from the hydrocracking conditions and from the catalyst residues. A part of the sediments is constituted by asphaltenes precipitated under the hydrocracking conditions and they are analyzed as existing sediments (IP375).

Depending on the hydrocracking conditions, the sediment content in the heavy fraction varies. From an analytical point of view, a distinction is made between the existing sediments (IP375) and the sediments after ageing (IP390) which include the potential sediments. More severe hydrocracking conditions, i.e. when the conversion rate is for example greater than 30, 40 or 50% depending on the feedstock, cause the formation of existing sediments and of potential sediments.

In order to obtain a fuel oil or a fuel-oil base having a reduced sediment content, in particular a bunker oil or a bunker oil base complying with the recommendations of a sediment content after ageing (IP390) of less than or equal to 0.1%, the process according to the invention comprises a maturation stage making it possible to improve the effectiveness of separation of the sediments and thus to obtain stable fuel oils or fuel-oil bases, i.e. a sediment content after ageing of less than or equal to 0.1% by weight.

The maturation stage according to the invention makes it possible to form all of the existing and potential sediments (by converting the potential sediments into existing sediments) so as to separate them more effectively and thus to respect the sediment content after ageing (IP390) of 0.1% by weight at most.

The maturation stage according to the invention is advantageously implemented for a residence time comprised between 1 and 1500 minutes, preferably between 25 and 300 minutes, more preferably between 60 and 240 minutes, at a temperature between 50 and 350° C., preferably between 75 and 300° C. and more preferably between 100 and 250° C., a pressure advantageously of less than 20 MPa, preferably less than 10 MPa, more preferably less than 3 MPa and even more preferably less than 1.5 MPa.

The maturation stage can be carried out using an exchanger or furnace followed by one or more enclosure(s) in series or in parallel such as a horizontal or vertical drum, optionally with a decantation function for removing a part of the heaviest solids, and/or a piston reactor. A stirred and heated vessel can also be used, and can be equipped with a drawing-off device at the bottom for removing a part of the heaviest solids.

Advantageously, the stage c) of maturation of the heavy fraction originating from stage b) is carried out in the presence of an inert gas and/or an oxidizing gas.

The maturation stage c) is carried out in the presence of an inert gas such as nitrogen, or in the presence of an oxidizing gas such as oxygen, or in the presence of a mixture containing an inert gas and an oxidizing gas such as air or nitrogen-depleted air. The use of an oxidizing gas makes it possible to accelerate the maturation process.

In the case where the maturation stage is carried out in the presence of an inert and/or oxidizing gas, said gas is mixed with the heavy fraction originating from stage b) before the maturation stage, then this gas is separated after the maturation so as to obtain a liquid fraction at the outlet of the maturation stage c). Such a use of gas/liquid can for example be carried out in a bubble tower. According to another implementation, the inert and/or oxidizing gas can also be introduced during the maturation stage c), for example by means of bubbling (injection of gas through the base) into a stirred tank, which makes it possible to promote the gas/liquid contact.

At the end of the maturation stage c), at least one hydrocarbon-containing fraction is obtained having a content enriched with existing sediments, which is sent into the stage d) of separating the sediments.

Stage d): Separation of the Sediments

The process according to the invention moreover comprises a stage d) of separating the sediments and residues of catalysts.

The heavy fraction obtained at the end of the maturation stage c) contains organic sediments of the precipitated asphaltenes type, which result from the hydrocracking and maturation conditions. This heavy fraction can also contain catalyst fines originating from the attrition of catalysts of the extrudates type in the implementation of the hydrocracking reactor. This heavy fraction can optionally contain "dispersed"-catalyst residues in the case where a hybrid reactor is used.

Thus, at least a part of the heavy fraction originating from the maturation stage c) is subjected to a separation of the sediments and of the residues of catalysts, by means of at least one physical separation means selected from a filter, a separation membrane, a filtering bed of solids of the organic or inorganic type, an electrostatic precipitation, a centrifugation system, decantation, drawing-off by means of an endless screw. A combination, in series and/or in parallel, of several separation means of the same type or of different types can be used during this stage d) of separating the sediments and residues of catalysts. One of these solid-liquid separation techniques can require the periodic use of a light rinsing fraction, originating from the process or not, making it possible for example to clean a filter and remove the sediments.

The heavy fraction originating from stage d) with a reduced sediment content can advantageously serve as a fuel-oil base or as a fuel oil, in particular as a bunker oil base or as a bunker oil, having a sediment content after ageing of less than 0.1% by weight. Advantageously, said heavy fraction is mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil.

Optional Stage e): Optional Separation Stage

The effluent obtained at the end of the stage d) of separating the sediments can undergo an optional separation stage making it possible to separate at least one light hydrocarbon fraction containing fuel bases and a heavy fraction containing mainly compounds boiling at at least 350° C.

This separation stage can advantageously be implemented using any method known to a person skilled in the art, such as for example the combination of one or more high- and/or low-pressure separators, and/or high- and/or low-pressure distillation and/or stripping stages. This optional separation stage e) is similar to the separation stage b) and will not be described further.

Preferably, this separation stage makes it possible to obtain at least one light hydrocarbon fraction of the naphtha, kerosene and/or diesel type, a vacuum distillate fraction and a vacuum residue fraction and/or an atmospheric residue fraction.

A part of the atmospheric residue and/or of the vacuum residue can also be recycled into the hydrocracking stage a).

Stage f): Optional Hydrotreatment Stage

The sulphur content of the heavy fraction originating from stage d) or e) when the latter is implemented, and containing mainly compounds boiling at at least 350° C., is a function of the operating conditions of the hydrocracking stage but also the sulphur content of the original feedstock.

Thus, for feedstocks with a low sulphur content, generally of less than 1.5% by weight, it is possible to directly obtain a heavy fraction with less than 0.5% by weight of sulphur, as required for vessels not equipped with fume treatment and operating outside the SECAs for the 2020-2025 time frame.

For feedstocks containing more sulphur, the sulphur content of which is generally greater than 1.5% by weight, the sulphur content of the heavy fraction can exceed 0.5% by weight. In such a case, a fixed-bed hydrotreatment stage f) is made necessary in the case where the refiner desires to decrease the sulphur content, in particular for a bunker oil base or a bunker oil intended to be burned on a vessel not equipped with fume treatment.

The fixed-bed hydrotreatment stage f) is implemented on at least a part of the heavy fraction originating from stage d) or e) when stage e) is implemented. The heavy fraction originating from stage f) can advantageously serve as a fuel-oil base or as a fuel oil, in particular as a bunker oil base or as a bunker oil, having a sediment content after ageing of less than 0.1% by weight. Advantageously, said heavy fraction is mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil.

The heavy fraction originating from the stage of separating the sediments d) or e) when stage e) is implemented is sent to the hydrotreatment stage f) comprising one or more fixed-bed hydrotreatment zones. Sending a heavy fraction depleted of sediments into a fixed bed constitutes an advantage of the present invention because the fixed bed will be less susceptible to clogging and to the increase in pressure drop.

By hydrotreatment (HDT) is meant in particular hydrodesulphurization (HDS) reactions, hydrodenitrogenation (HDN) reactions and hydrodemetallization (HDM) reactions, but also hydrogenation, hydrodeoxygenation, hydrodearomatization, hydroisomerization, hydrodealkylation, hydrocracking, hydrodeasphalting, reduction of Conradson carbon.

Such a process of hydrotreating heavy cuts is widely known and can resemble the process known as HYVAHL-F™ described in the U.S. Pat. No. 5,417,846.

A person skilled in the art will easily understand that in the hydrodemetallization stage mainly hydrodemetallization reactions are carried out, but also, in parallel, a part of the hydrodesulphurization reactions. Similarly, in the hydrodesulphurization stage, mainly hydrodesulphurization reactions are carried out, but also, in parallel, a part of the hydrodemetallization reactions.

According to a variant, a co-feedstock can be introduced with the heavy fraction in the hydrotreatment stage f). This co-feedstock can be selected from atmospheric residues, vacuum residues originating from direct distillation, deasphalted oils, aromatic extracts originating from lubricant base production chains, hydrocarbon-containing fractions or a mixture of hydrocarbon-containing fractions able to be selected from the products originating from a fluid catalytic cracking process: a light cycle oil (LCO), a heavy cycle oil (HCO), a decanted oil, or able to originate from distillation, gas oil fractions, in particular those obtained by atmospheric or vacuum distillation, such as for example vacuum gas oil.

The hydrotreatment stage can advantageously be implemented at a temperature comprised between 300 and 500° C., preferably 350° C. to 420° C. and under a partial pressure of hydrogen advantageously comprised between 2 MPa and 25 MPa, preferably between 10 and 20 MPa, an overall hourly space velocity (HSV) situated in a range from 0.1 h−1 to 5 h−1 and preferably 0.1 h−1 to 2 h−1, a quantity of hydrogen mixed with the feedstock usually of 100 to 5000 Nm3/m3 (normal cubic meters (Nm3) per cubic meter (m3) of liquid feedstock), most often of 200 to 2000 Nm3/m3 and preferably of 300 to 1500 Nm3/m3.

Normally, the hydrotreatment stage is carried out industrially in one or more reactors with a descending flow of liquid. The hydrotreatment temperature is generally adjusted as a function of the desired level of hydrotreatment.

The hydrotreatment catalysts used are preferably known catalysts and are generally granular catalysts comprising, on a support, at least one metal or metal compound having a hydrodehydrogenating function. These catalysts are advantageously catalysts comprising at least one metal of group VIII, generally selected from the group formed by nickel and/or cobalt, and/or at least one metal of group VIB, preferably molybdenum and/or tungsten. For example a catalyst comprising 0.5 to 10% by weight of nickel and preferably 1 to 5% by weight of nickel (expressed as nickel oxide NiO) and 1 to 30% by weight of molybdenum, preferably 5 to 20% by weight of molybdenum (expressed as molybdenum oxide $MoO_3$) on a mineral support will be used. This support will, for example, be selected from the group formed by alumina, silica, silica-aluminas, magnesia, clays and mixtures of at least two of these minerals. Advantageously, this support includes other doping compounds, in particular oxides selected from the group formed by boron oxide, zirconia, cerite, titanium oxide, phosphoric anhydride and a mixture of these oxides. An alumina support is most often used, and a support of alumina doped with phosphorus and optionally boron is very often used. The concentration of phosphoric anhydride $P_2O_5$ is normally comprised between 0 or 0.1% and 10% by weight. The concentration of boron trioxide $B_2O_3$ is normally comprised between 0 or 0.1% and 10% by weight. The alumina used is normally a $\gamma$ or $\eta$ alumina. This catalyst is most often in the form of extrudates. The total content of oxides of metals of groups VIB and VIII is often 5 to 40% by weight and generally 7 to 30% by weight and the weight ratio expressed as metallic oxide between a metal (or metals) of group VIB and a metal (or metals) of group VIII is generally 20 to 1 and most often 10 to 2.

In the case of a hydrotreatment stage including a hydrodemetallization (HDM) stage, then a hydrodesulphurization (HDS) stage, specific catalysts adapted to each stage are most often used.

Catalysts that can be used in the hydrodemetallization (HDM) stage are for example indicated in the patents EP113297, EP113284, U.S. Pat. No. 5,221,656, U.S. Pat. No. 5,827,421, U.S. Pat. No. 7,119,045, U.S. Pat. No. 5,622,616 and U.S. Pat. No. 5,089,463. Hydrodemetallization (HDM) catalysts are preferably used in switchable reactors. Catalysts that can be used in the hydrodesulphurization (HDS) stage are for example indicated in the patents EP113297, EP113284, U.S. Pat. No. 6,589,908, U.S. Pat. No. 4,818,743 or U.S. Pat. No. 6,332,976. A mixed catalyst that is active in hydrodemetallization and in hydrodesulphurization can also be used both for the hydrodemetallization (HDM) section and for the hydrodesulphurization (HDS) section, as described in the patent FR2940143.

Prior to the injection of the feedstock, the catalysts used in the process according to the present invention are preferably subjected to an in situ or ex situ sulphurization treatment.

Stage g): Optional Stage of Separating the Hydrotreatment Effluent

The optional separation stage g) can advantageously be implemented using any method known to a person skilled in the art, such as for example the combination of one or more high- and/or low-pressure separators, and/or high- and/or low-pressure distillation and/or stripping stages. This optional separation stage g) is similar to the separation stage b) and will not be described further.

In a variant embodiment of the invention the effluent obtained at stage f) can be at least partially, and often completely, sent into a separation stage g), comprising an atmospheric distillation and/or a vacuum distillation. The effluent from the hydrotreatment stage is fractionated by atmospheric distillation into a gaseous fraction, at least one atmospheric distillate fraction containing the fuel bases (naphtha, kerosene and/or diesel) and an atmospheric residue fraction. At least a part of the atmospheric residue can then be fractionated by vacuum distillation into a vacuum distillate fraction containing vacuum gas oil and a vacuum residue fraction.

The vacuum residue fraction and/or the vacuum distillate fraction and/or the atmospheric residue fraction can at least partially constitute the low-sulphur fuel-oil bases having a sulphur content of less than or equal to 0.5% by weight and a sediment content after ageing of less than or equal to 0.1%. The vacuum distillate fraction can constitute a fuel-oil base having a sulphur content of less than or equal to 0.1% by weight.

A part of the vacuum residue and/or of the atmospheric residue can also be recycled into the hydrocracking stage a).

Fluxing

In order to obtain a fuel oil, the heavy fractions originating from stages d) and/or e) and/or f) and/or g) can be mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil. Preferably, kerosene, gas oil and/or vacuum distillate produced in the process of the invention will be used. Advantageously, kerosene, gas oil and/or vacuum distillate obtained in the separation stages b) or g) of the process will be used.

Detailed Description of FIG. 1

FIG. 1 shows an implementation example according to the invention without limiting the scope thereof.

In FIG. 1, the feedstock (10), pre-heated in the chamber (92), mixed with recycled hydrogen (14) and make-up hydrogen (90) pre-heated in the chamber (91), is introduced through the pipeline (96) into the hydrocracking stage at the base of the first ebullating-bed reactor (98) operating with ascending flow of liquid and gas and containing at least one hydrocracking catalyst of the supported type. Advantageously, a co-feedstock (94) can be introduced. Advantageously, the first ebullating-bed reactor functions in hybrid mode, the "dispersed"-type catalyst is then introduced via the pipeline (100) upstream of the first hydrocracking reactor (98).

Advantageously, the converted effluent (104) originating from the reactor (98) can be subjected to a separation of the light fraction (106) in an inter-stage separator (108). All or part of the effluent (110) originating from the inter-stage separator (108) is advantageously mixed with additional hydrogen (157), if required pre-heated beforehand (not shown).

This mixture is then injected through the pipeline (112) into a second hydrocracking reactor (102) also using an ebullating bed operating with ascending flow of liquid and gas containing at least one hydrocracking catalyst of the supported type.

Advantageously, the second ebullating-bed reactor functions in hybrid mode, the "dispersed"-type catalyst is then injected upstream of the first reactor (98) in the case of two hybrid reactors in series, or the "dispersed"-type catalyst is injected upstream of the second reactor (102) via a pipeline, not shown, in the case of a first ebullating-bed reactor followed by a second hybrid reactor.

The operating conditions, in particular the temperature, in this reactor are selected so as to achieve the conversion level sought, as described previously.

The effluent from the hydrocracking reactors is sent, through the line (134), into a high pressure high temperature (HPHT) separator (136) from which a gaseous fraction (138) and a heavy fraction (140) are recovered. The gaseous fraction (138) is generally sent, via an exchanger (not shown) or an air cooler (142) for cooling, to a high pressure low temperature (HPLT) separator (144) from which a gaseous fraction (146) containing the gases (H2, H2S, NH3, C1-C4 hydrocarbons, etc.) and a liquid fraction (148) are recovered.

The gaseous fraction (146) from the high pressure low temperature (HPLT) separator (144) can be treated in a hydrogen purification unit (150) from which the hydrogen (152) is recovered for recycling, via the compressor (154) and the line (156) and/or the line (157), to the hydrocracking section. The gases containing undesirable nitrogen-containing and sulphur-containing compounds are discharged from the installation flow (158) which can represent several flows, in particular a flow rich in H2S and one or more purges containing light hydrocarbons. The liquid fraction (148) from the high pressure low temperature (HPLT) separator (144) is advantageously expanded in the device (160) to be sent to the fractionation system (172).

The heavy fraction (140) originating from the high pressure high temperature (HPHT) separation (136) is advantageously expanded in the device (174) then sent to the fractionation system (172). Optionally, a medium pressure separator (not shown) after the expander (174) can be installed in order to recover a vapour phase, which is sent to the purification unit (150) and/or to a dedicated medium pressure purification unit (not shown), and a liquid phase which is taken to the fractionation section (172).

The fractions (148) and (140) can be sent together, after expansion, to the system (172). The fractionation system (172) comprises an atmospheric distillation system for producing a gaseous effluent (176), at least one fraction known as light (178), containing in particular naphtha, kerosene and diesel, and an atmospheric residue fraction (180). All or part of the atmospheric residue fraction (180) can be sent to a vacuum distillation column (184) to recover a fraction containing the vacuum residue (186) and a vacuum distillate fraction (188) containing vacuum gas oil.

The atmospheric residue fraction (182) and/or the vacuum residue fraction (186) are subjected to a stage of maturation and separation of the sediments and residues of catalysts in order to constitute the sought fuel-oil bases.

A fraction (182) of the atmospheric residue type is optionally pre-heated in a furnace or an exchanger (205) so as to reach the temperature necessary for the maturation (conversion of the potential sediments into existing sediments) which takes place in the enclosure (207). The function of the enclosure (207) is to ensure a residence time necessary for the maturation, it can therefore be a horizontal or vertical drum, a buffer tank, a stirred tank or a piston reactor. The heating function can be incorporated in the enclosure in the case of a heated stirred tank according to an embodiment, not shown. The enclosure (207) can also make decantation possible so as to remove a part of the solids (208).

The flow (209) originating from the maturation is then subjected to a solid-liquid separation (191) so as to obtain a fraction (212) with a reduced sediment content and a fraction (211) rich in sediments. In a similar way, a fraction (186) of the vacuum residue type is optionally preheated in a furnace or an exchanger (213) so as to reach the temperature necessary for the maturation which takes place in the enclosure (215). The function of the enclosure (215) is to ensure a residence time necessary for the maturation, it can therefore be a horizontal or vertical drum, a buffer tank, a stirred tank or a piston reactor. The heating function can be incorporated in the enclosure in the case of a heated stirred tank according to an embodiment, that is not shown.

The enclosure (215) can also make decantation possible so as to remove a part of the solids (216). The flow (217) originating from the maturation is then subjected to a solid-liquid separation (192) so as to obtain a fraction (219) with a reduced sediment content and a fraction (218) rich in sediments.

According to an embodiment, that is not shown, the maturation devices (207) and (215) can operate in the presence of a gas, in particular an inert or oxidizing gas, or a mixture of inert gas and oxidizing gas. In the case where gas is used during the maturation, a device, not shown, will make it possible to separate the gas from the liquid. According to a mode, not shown, it is also possible to carry out a stage of maturation and separation of the sediments and residues of catalysts on a heavy fraction originating from the stage of separating the effluent originating from the hydrocracking, for example on a heavy cut originating from a separator, for example on the flow (140) before or after the expansion (174). An advantageous mode, not shown, can consist of carrying out the stage of maturation and separation of the sediments on the flow recovered at the bottom of a stripping column. When the stage of maturation and separation of the sediments and residues of catalysts is carried out upstream of a distillation column, this column is less susceptible to clogging.

At least a part of the flows (188) and/or (212) and/or (219) constitutes one or more of the fuel-oil bases sought, in particular of the bases for bunker oils with a low sediment content. A part of the flows (188) and/or (212) and/or (219), before or after the optional stage of maturation and separation of the sediments, can be recycled, via the line (190), to the hydrocracking stage.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 14/60.628, filed Nov. 4, 2014 are incorporated by reference herein.

EXAMPLES

The following example illustrates the invention but without limiting its scope. The feedstock treated is a vacuum residue (Ural VR), the characteristics of which are indicated in Table 1.

TABLE 1

Characteristics of the feedstock

| Cut | Ural VR |
|---|---|
| Density 15/4 | 1.018 |
| Sulphur % by mass | 2.60 |
| Conradson carbon | 14 |
| C7 asphaltenes (% by mass) | 4.1 |
| NI + V ppm | 172 |
| 350° C.+ (% by mass of compounds boiling above 350° C.) | 97.5 |
| 540° C.+ (% by mass of compounds boiling above 540° C.) | 70.3 |

The feedstock is subjected to a hydrocracking stage in two successive ebullating-bed reactors.

According to a variant carried out in a second experiment, the two ebullating-bed reactors are operated in hybrid mode, i.e. using a dispersed catalyst injected at the inlet to the first reactor in addition to the supported catalysts. The operating conditions of the hydrocracking section are given in Table 2.

The NiMo on Alumina catalyst used is sold by the company Axens under the reference HOC458.

TABLE 2

Hydrocracking section operating conditions

| Catalyst | 2 ebullating beds NiMo on alumina | 2 hybrid ebullating beds NiMo on alumina + Mo naphthenate |
|---|---|---|
| Temperature of ebullating bed R1 (° C.) | 420 | 420 |
| Temperature of ebullating bed R2 (° C.) | 425 | 425 |
| Partial pressure of hydrogen, MPa | 15 | 15 |
| $HSV_C$ ($Sm^3$/h feedstock/$m^3$ supported catalysts), $h^{-1}$ | 0.55 | 0.55 |
| $HSV_R$ ($Sm^3$/h feedstock/$m^3$ reactors), $h^{-1}$ | 0.3 | 0.3 |
| Concentration of dispersed catalyst (ppm of precursor in the feedstock at hybrid beds inlet) | 0 | 100 |
| $H_2$ inlet ($Nm^3/m^3$ feedstock) | 600 | 600 |

$HSV_C$: ratio between the hourly volume flow rate of feedstock and the volume of supported catalysts without boiling
$HSV_R$: ratio between the hourly volume flow rate of feedstock and the volume of the reactors The hydrocracking effluents are then subjected to a separation comprising an atmospheric distillation and making it possible to recover a gaseous fraction and a heavy fraction. The heavy fraction (350° C.+ fraction) is then treated according to two variants:

A) No additional treatment (not according to the invention)

B) A stage of maturation of the sediments (4 h at 150° C. carried out in a heated stirred tank in the presence of a 50/50 air/nitrogen mixture under a pressure of 0.5 MPa) then a stage of physically separating the sediments using a filter (according to the invention)

According to the two preceding variants A) and B), the 350° C.+ fractions are distilled in the laboratory with a view to discovering the qualities and yields of vacuum distillate and vacuum residue. The yields and the sulphur content and the viscosity (for the heavy cuts) according to the two embodiments of the hydrocracking stage (ebullating beds or hybrid beds) are indicated in Table 3.

TABLE 3

Yields, sulphur content and viscosity in ebullating-bed section (% by weight/feedstock)

| | 2 ebullating beds | | | 2 hybrid ebullating beds | | |
|---|---|---|---|---|---|---|
| Products | Yield (% by weight) | S (% by weight) | Viscosity at 100° C. (cSt) | Yield (% by weight) | S (% by weight) | Viscosity at 100° C. (cSt) |
| $NH_3$ | 0.08 | | | 0.08 | | |
| $H_2S$ | 2.29 | | | 2.30 | | |
| C1-C4 (gas) | 3.94 | | | 4.62 | | |
| Naphtha (PI-180° C.) | 9.53 | 0.07 | | 11.70 | 0.12 | |
| Diesel (180-350° C.) | 24.81 | 0.17 | | 28.87 | 0.20 | |
| Vacuum distillates (350-540° C.) | 39.73 | 0.45 | 7.4 | 36.12 | 0.51 | 7.2 |
| Vacuum residue (540+° C.) | 21.13 | 0.76 | 277 | 17.93 | 0.88 | 579 |
| Total | 101.51 | | | 101.61 | | |
| $H_2$ consumed (% by weight/feedstock) | 1.51 | | | 1.61 | | |
| Feedstock in maturation stage: Total of the yields of vacuum distillates (350-540° C.) and vacuum residue (540+° C.) | 60.86 | 0.56 | | 54.05 | 0.63 | |

The operating conditions of the hydrocracking stage coupled with a stage of maturation and separation of the sediments according to the invention carried out on the heavy fraction originating from the atmospheric distillation have an impact on the stability of the effluents obtained. This is illustrated by the sediment contents after ageing measured in the atmospheric residues (350° C.+ cut). The performances are summarized in Table 4 below.

TABLE 4

Summary of the performances with or without maturation and separation of the sediments

| | Hydrocracking in 2 ebullating beds (420/425° C.) | | Hydrocracking in 2 hybrid ebullating beds (420/425° C.) | |
|---|---|---|---|---|
| Hydrodesulphurization rate (%) | 78.5 | | 75.8 | |
| Conversion rate (%) | 70 | | 74.5 | |
| Maturation | No | Yes | No | Yes |
| Separation of the sediments | No | Yes | No | Yes |
| Sediment content after ageing (IP390) in the 350° C.+ cut | 0.8 | <0.1 | 0.7 | <0.1 |

Conversion rate = ((quantity of 540° C.+ cut of the feedstock − quantity of 540° C.+ cut of the effluent)/(quantity of 540° C.+ cut of the feedstock))
Hydrodesulphurization rate = ((quantity of sulphur of the feedstock − quantity of sulphur of the effluent)/quantity of sulphur of the feedstock)

According to the invention, whether the hydrocracking stage is carried out with two ebullating beds or two hybrid beds, it is possible to obtain stable effluents with a low sediment content when a maturation stage then a stage of separating the sediments are implemented.

It is also possible to subject the effluents originating from the stages of maturation and separation of the sediments to a fixed-bed hydrotreatment stage. The operating conditions of the hydrotreatment stage are indicated in Table 5.

The CoMoNi on Alumina catalysts used are sold by the company Axens under the references HF858, HM848 and HT438.

TABLE 5

Operating conditions of the hydrotreatment stage carried out on the 350+ cuts originating from the hydrocracking stage after passing to the stage of maturation and separation of the sediments

| HDM and HDS catalysts | CoMoNi on alumina |
|---|---|
| Cycle starting temperature (° C.) | 370 |
| H2 partial pressure (MPa) | 15 |
| HSV (h-1, Sm3/h fresh feedstock/m3 of fixed-bed catalyst) | 0.21 |
| H2/HC at inlet of fixed-bed section not including H2 consumption (Nm3/m3 of fresh feedstock) | 1000 |

The effluents originating from the hydrotreatment stage are then separated and analyzed. The vacuum distillate fractions contain less than 0.2% by weight of sulphur. The vacuum residue fractions contain less than 0.5% by weight of sulphur. Vacuum distillate fractions and vacuum residues (or atmospheric residue fractions) are thus obtained with a low sulphur content and a low sediment content after ageing. These fractions thus constitute excellent fuel-oil bases and in particular excellent bunker oil bases.

The invention claimed is:

1. Process for converting a hydrocarbon-containing feedstock containing at least one hydrocarbon fraction having a sulphur content of at least 0.1% by weight, an initial boiling temperature of at least 340° C. and a final boiling temperature of at least 440° C., to obtain a heavy fraction having a sediment content after ageing of less than or equal to 0.1% by weight, said process comprising the following stages:

a) hydrocracking the feedstock in the presence of hydrogen in at least one reactor containing a supported catalyst in an ebullating bed, b) separating an effluent obtained at the end of stage a) into at least one light hydrocarbon fraction containing fuel bases and a heavy fraction containing compounds boiling at at least 350° C., c) a stage of maturation of the heavy fraction originating from the separation stage b) converting a part of the potential sediments to existing sediments, carried out for a duration comprised between 60 to 240 minutes, at a temperature comprised between 50 and 350° C., and at a pressure of less than 20 MPa, d) separating the sediments from the heavy fraction originating from the maturation stage c) in order to obtain said heavy fraction wherein the stage c) of maturation of the heavy fraction originating from stage b) is carried out in the presence of an oxidizing gas or in the presence of a mixture of an inert gas and an oxidizing gas.

2. Process according to claim 1 in which the hydrocracking stage a) is carried out at a partial pressure of hydrogen of 5 to 35 MPa, at a temperature of 330 to 500° C., a space velocity ranging from 0.05 h-1 to 5 h-1 and the quantity of hydrogen mixed with the feedstock is from 50 to 5000 Nm3/m3.

3. Process according to claim 1 in which the hydrocracking stage is carried out in at least one reactor operating in hybrid bed mode.

4. The process of claim 3 wherein the hybrid bed mode is operating using an ebullating bed with a supported catalyst combined with a dispersed catalyst constituted by very fine particles of catalyst, all forming a suspension with the feedstock to be treated.

5. Process according to claim 1 in which the separation stage d) is carried out by means of at least one separation means selected from a filter, a separation membrane, a filtering bed of solids of the organic or inorganic type, an electrostatic precipitation, a centrifugation system, decantation, drawing-off by means of an endless screw.

6. Process according to claim 1 in which at least a part of the fraction known as heavy originating from stage b) is fractionated by atmospheric distillation into at least one atmospheric distillate fraction containing at least one light hydrocarbon fraction of the naphtha, kerosene and/or diesel type and an atmospheric residue fraction.

7. Process according to claim 1 in which the effluent obtained at the end of the stage d) of separating the sediments undergoes a separation stage e) making it possible to separate at least one light hydrocarbon fraction containing fuel bases and a heavy fraction containing mainly compounds boiling at at least 350° C.

8. Process according to claim 1 also comprising a fixed-bed hydrotreatment stage f) implemented on at least a part of the heavy fraction originating from stage d) or e) in which the heavy fraction and hydrogen are passed over a hydrotreatment catalyst under hydrotreatment conditions.

9. Process according to claim 8 in which the hydrotreatment stage is carried out at a temperature comprised between 300 and 500° C., a partial pressure of hydrogen comprised between 2 MPa and 25 MPa, an overall hourly space velocity (HSV) situated in a range from 0.1 h-1 to 5 h-1, a quantity of hydrogen mixed with the feedstock of 100 to 5000 Nm3/m3.

10. Process according to claim 8 in which a co-feedstock is introduced with the heavy fraction to the hydrotreatment stage f).

11. Process according to claim 10 in which the co-feedstock is selected from atmospheric residues, vacuum residues originating from direct distillation, deasphalted oils, aromatic extracts originating from lubricant base production chains, hydrocarbon-containing fractions or a mixture of hydrocarbon-containing fractions able to be selected from the products originating from a fluid catalytic cracking process: a light cycle oil (LCO), a heavy cycle oil (HCO), a decanted oil, or can come from distillation, gas oil fractions, in particular those obtained by atmospheric or vacuum distillation, such as for example vacuum gas oil.

12. Process according to claim 1 in which the feedstock treated is selected from atmospheric residues, vacuum residues originating from direct distillation, crude oils, topped crude oils, deasphalted oils, deasphalting resins, asphalts or deasphalting pitches, residues originating from conversion processes, aromatic extracts originating from lubricant base production chains, bituminous sands or derivatives thereof, oil shales or derivatives thereof, alone or in a mixture.

13. Process according to claim 1 in which the final boiling temperature of the feedstock is at least 540° C.

14. Process according to claim 1 in which the feedstock contains at least 1% C7 asphaltenes and at least 5 ppm of metals.

15. Process according to claim 1 in which the heavy fractions originating from stages d) and/or e) and/or f) and/or g) are mixed with one or more fluxing bases selected from the group constituted by the light cycle oils of a catalytic cracking, the heavy cycle oils of a catalytic cracking, the residue of a catalytic cracking, a kerosene, a gas oil, a vacuum distillate and/or a decanted oil.

16. The process of claim 1 wherein the mixture of an inert gas and an oxidizing gas is air or nitrogen-depleted air.

17. The process of claim 1 wherein a heavy fraction having a sediment content after ageing of less than or equal to 0.1% by weight is obtained.

* * * * *